US007763802B2

(12) United States Patent
Varkey et al.

(10) Patent No.: US 7,763,802 B2
(45) **Date of Patent: *Jul. 27, 2010**

(54) ELECTRICAL CABLE

(75) Inventors: Joseph Varkey, Sugar land, TX (US); Vladimir Hernandez-Solis, Stafford, TX (US); Ramon Hernandez-Marti, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 266 days.

This patent is subject to a terminal disclaimer.

(21) Appl. No.: 11/847,859

(22) Filed: Aug. 30, 2007

(65) Prior Publication Data

US 2008/0236867 A1 Oct. 2, 2008

Related U.S. Application Data

(60) Provisional application No. 60/825,507, filed on Sep. 13, 2006.

(51) Int. Cl.
*H01B 7/18* (2006.01)

(52) U.S. Cl. ..... 174/106 R; 174/113 R

(58) Field of Classification Search ..... 174/102 R, 174/106 R, 113 R, 116
See application file for complete search history.

(56) References Cited

U.S. PATENT DOCUMENTS 3,115,542 A * 12/1963 Palandri et al. ..... 174/102 R
3,639,674 A * 2/1972 Stier ..... 174/36
5,495,547 A * 2/1996 Rafie et al. ..... 385/101
6,297,455 B1 * 10/2001 Wijnberg et al. ..... 174/113 R
6,600,108 B1 7/2003 Mydur et al.
6,924,436 B2 8/2005 Varkey et al.
6,960,724 B2 11/2005 Orlet et al.
7,005,583 B2 2/2006 Varkey et al.
7,009,113 B2 3/2006 Varkey
7,119,283 B1 10/2006 Varkey et al.
7,170,007 B2 1/2007 Varkey et al.
7,188,406 B2 3/2007 Varkey et al.
7,235,743 B2 6/2007 Varkey
7,259,331 B2 8/2007 Sridhar et al.
7,288,721 B2 10/2007 Varkey et al.
2004/0118590 A1 * 6/2004 Head ..... 174/105 R

* cited by examiner

*Primary Examiner*—Chau N Nguyen
(74) *Attorney, Agent, or Firm*—Michael Flynn; David Hofman; Jody DeStefanis

(57) ABSTRACT

An electrical cable includes insulated primary conductors and at least one insulated secondary conductor, which extend along the cable. The primary conductors define interstitial spaces between adjacent primary conductors, and the primary conductors have approximately the same diameter. The primary conductors include power conductors and a telemetric conductor. The secondary conductor(s) each have a diameter that is smaller than each of the diameters of the primary conductors, and each secondary conductor is at least partially nested in one of the interstitial spaces. The electrical cable may include at least one fiber optic line.

19 Claims, 8 Drawing Sheets

ELECTRICAL CABLE

This application claims the benefit under 35 U.S.C. §119 (e) to U.S. Provisional Patent Application Ser. No. 60/825,507 entitled, "HIGH POWER TELEMETRY DECOUPLED WIRELINE CABLES," which was filed on Sep. 13, 2006, and is hereby incorporated by reference in its entirety.

BACKGROUND

The invention generally relates to an electrical cable, such as (as an example) a multi-conductor electrical cable of the type used in an oilfield wireline logging operation for purposes of analyzing geologic formations adjacent a wellbore.

Generally, geologic formations within the earth that contain oil and/or petroleum gas have properties that may be linked with the ability of the formations to contain such products. For example, formations that contain oil or petroleum gas have higher electrical resistivities than those that contain water. Formations that primarily include sandstone or limestone may contain oil or petroleum gas. Formations that primarily include shale, which may also encapsulate oil-bearing formations, may have porosities much greater than that of sandstone or limestone, but, because the grain size of shale is very small, it may be very difficult to remove the oil or gas trapped therein. Accordingly, logging operations are often conducted in the well before its completion for purposes of measuring various characteristics of the geologic formations adjacent to the well to help in determining the location of an oil- and/or petroleum gas-bearing formation, as well as the amount of oil and/or petroleum gas trapped within the formation and the ease of removing the oil and/or petroleum gas from the formation.

Therefore, after a well is drilled, it is common to log certain sections of the well with electrical instruments called logging tools. A wireline instrument is one type of logging tool. The wireline instrument is lowered downhole on a cable called a "wireline cable" for purposes of measuring the properties of geologic formations as the instrument traverses the well. The wireline cable electrically connects the wireline instrument with equipment at the earth's surface, as well as provides structural support to the instrument as it is lowered and raised in the well during the logging operation.

The wireline cable typically contains an infrastructure to communicate power to the wireline instrument and communicate telemetry data from the instrument to a surface logging unit. Because downhole temperatures and pressures may reach, for example, 500° Fahrenheit (F) and sometimes up to 25,000 pounds per square inch (psi), the wireline cable typically is designed to withstand extreme environmental conditions. Because wells are being drilled to deeper depths, the electricity and telemetry requirements of the wireline cable are ever increasing. Thus, in view of these more stringent requirements, the wireline cable designer is presented with challenges related to maintaining or increasing the signal-to-noise ratio (SNR) of the telemetry signals, minimizing telemetry signal attenuation, as well as accommodating the delivery of high power downhole.

SUMMARY

In an embodiment of the invention, an electrical cable includes insulated primary conductors and at least one insulated secondary conductor, which extend along the cable. The primary conductors define interstitial spaces between adjacent primary conductors, and the primary conductors have approximately the same diameter. The primary conductors include power conductors and at least one telemetric conductor. The secondary conductor(s) preferably each have a diameter that is smaller than each of the diameters of the primary conductors, and each secondary conductor is at least partially nested in one of the interstitial spaces. The electrical cable also includes at least one armor wire layer, which surrounds the primary and secondary conductors.

In another embodiment of the invention, an electrical cable includes insulated primary conductors; at least one insulated secondary conductor; layers of inner and outer armor wires; a polymeric material; and an outer jacket. The insulated primary conductors extend along the cable, and a telemetric primary conductor extends along the cable and defines interstices between adjacent primary conductors. The insulated primary conductors and the telemetric conductor have approximately the same diameter. Each secondary conductor has a diameter that is smaller than the diameter of each of the primary conductors and extends along the longitudinal axis of the cable. Each secondary conductor is at least partially nested in one of the interstices. The layer of inner armor wires surrounds the insulated primary conductors, the telemetric primary conductor and the secondary conductor(s). The layer of outer armor wires surrounds the layer of inner armor wires. The polymeric material is disposed in the interstitial spaces that are formed between the inner armor wires and the outer armor wires and interstitial spaces that are formed between the inner armor wire layer and the insulated conductor. The polymeric material forms a continuously bonded layer, which separates and encapsulates armor wires forming the inner armor wire layer and the outer wire layer. The outer jacket is disposed around and bonded to the polymeric material.

In yet another embodiment of the invention, a method includes providing a cable in a well; and including insulating primary conductors in the cable, which define interstitial spaces between adjacent primary conductors and have approximately the same diameter. The primary conductors include power conductors and a telemetric conductor. The method includes disposing at least one insulated secondary conductor having a diameter smaller than the primary conductor at least partially in one of the interstitial spaces defined by the primary conductors; and encasing the cable with an armor shield.

Advantages and other features of the invention will become apparent from the detailed description, drawing and claims.

DETAILED DESCRIPTION

Figure 1:
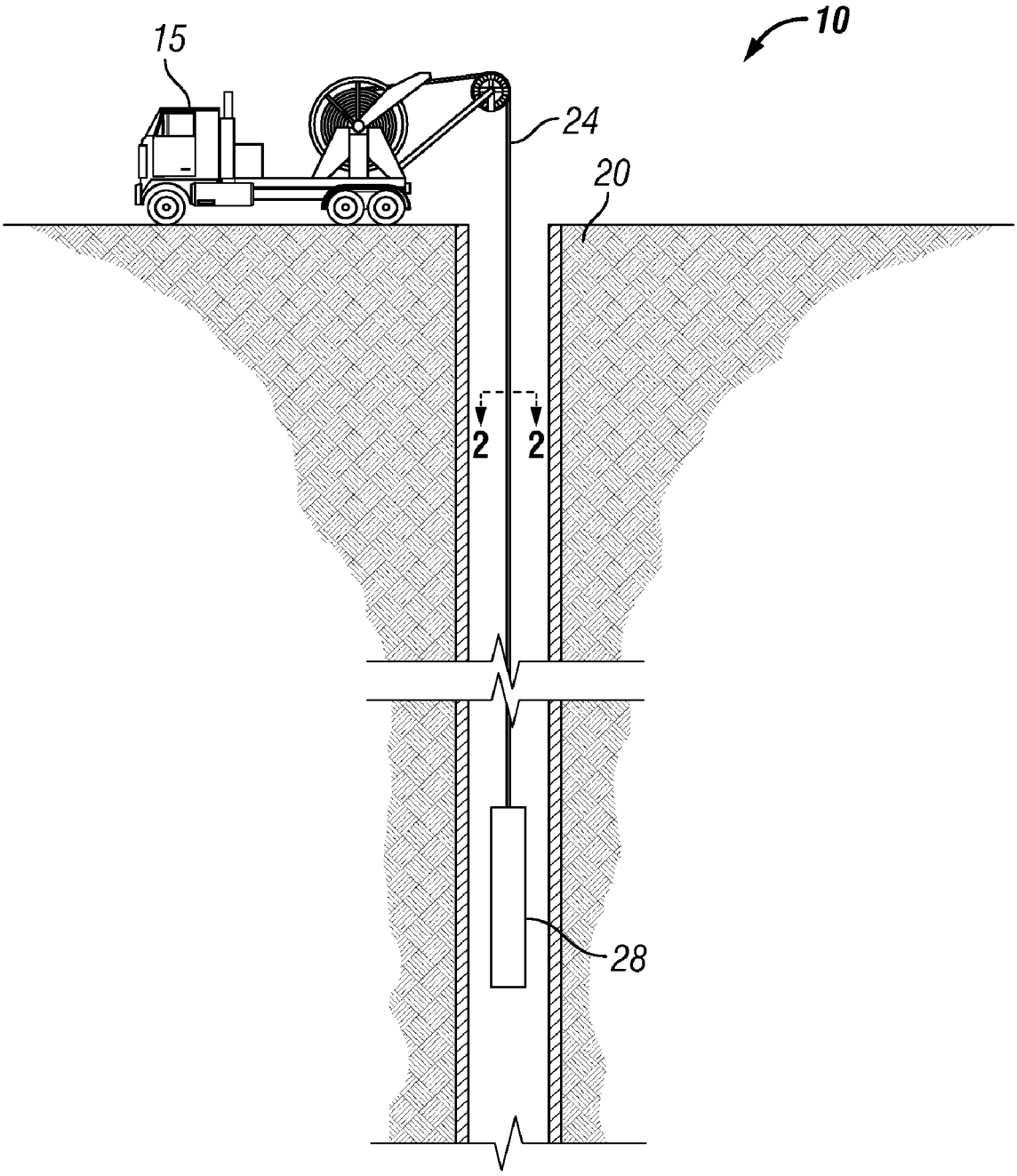
FIG. 1 is a schematic diagram of a wireline-based logging acquisition system according to an embodiment of the invention.

FIG. 1 depicts a wireline-based logging acquisition system 10 in accordance with embodiments of the invention. The system 10 includes a wireline logging instrument, or tool 28, which is deployed in a cased (as shown) or uncased borehole 20 and a wireline cable 24 that structurally and electrically connects the wireline logging tool 28 with equipment at the earth's surface. As described herein, the wireline cable 24 includes power and telemetry conductors for purposes of communicating power and telemetry data between the equipment at the surface and the tool 28. The well being logged by the system 10 may be a subterranean or subsea well.

As depicted in FIG. 1, the wireline cable 24 may be deployed via a truck 15, which contains a wireline spool, which lowers and raises the wireline tool 28 into the borehole 20 in connection with the logging operation. The logging tool 28 may include a gamma-ray emitter/receiver, a caliper device, a resistivity-measuring device, a neutron emitters/receivers or a combination of these devices, as just a few examples.

Figure 2:
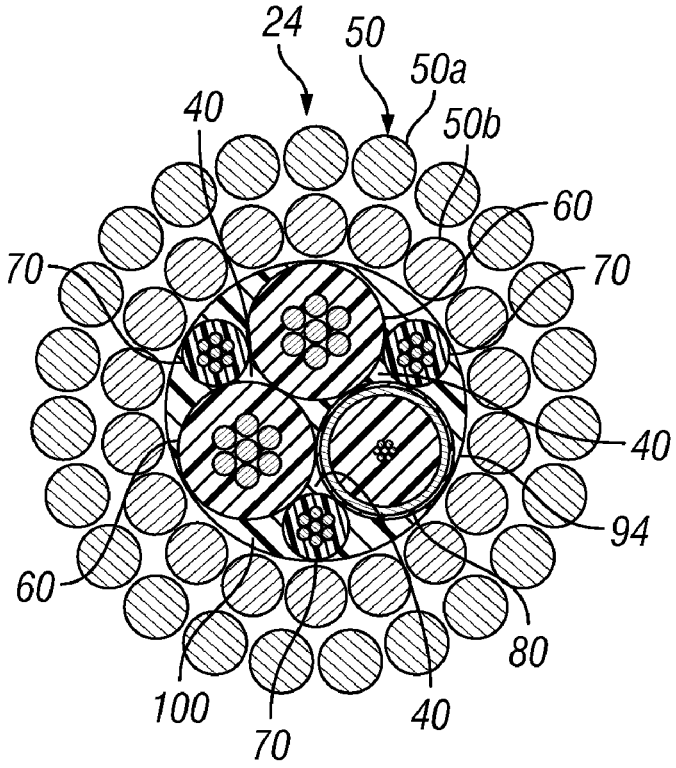
FIG. 2 is a cross-sectional view of a wireline cable taken along line 2-2 of FIG. 1 according to an embodiment of the invention.

Referring to FIG. 2, in accordance with embodiments of the invention described herein, the wireline cable 24 has features that, as compared to prior art cables, provide a relatively high power delivery capacity; a relatively high degree of structural integrity; and a relatively high signal strength, a relatively low noise floor and a relatively wide bandwidth for the telemetry communications. To accomplish this, the wireline cable 24 includes heavy gauge (i.e., large diameter) primary conductors: two similarly-sized primary conductors 60 for purposes of communicating a high level of power downhole; and a primary telemetric conductor 80, which has a diameter that is approximately the same as each of the primary power conductors 60. By using relatively heavy gauge primary conductors, more conductive material, such as copper, may be packed into a given cross-sectional area of the wireline cable 24. Thus, the cable 24 provides increased power delivery capacity when compared to a standard heptacable, for example. Furthermore, the cabling of the three relatively large diameter primary conductors together creates a mechanically stable base for the cable 24.

The wireline cable 24 also includes secondary conductors 70 (three conductors 70, for example), which are smaller in size (i.e., have relatively smaller diameters) than the primary conductors 60 and 80 and which may be used, for example, for purposes of communicating three phase power to the logging tool 28 (see FIG. 1). Alternatively, the secondary conductors 70 may be used for purposes of communicating low power, such as DC or single phase power, and one of the secondary conductors 70 may be used as a spare, for example. As another variation, one of the secondary conductors 70 may be used as a return path for power that is communicated downhole via the primary power conductors 60. Thus, many applications of the secondary conductors 70 are contemplated and are within the scope of the appended claims. Also, combinations between the primary power conductors 60 and the secondary power conductors 70 may be used to create alternative telemetry modes.

As depicted in FIG. 2, in accordance with embodiments of the invention, the primary conductors 60 and 80 are arranged in a triangular configuration about a longitudinal axis of the wireline cable 24, an arrangement which defines interstitial spaces 40 between each pair of adjacent primary conductors 60, 80. Each secondary conductor 70, being smaller in size, is preferably at least partially nested in one of the interstitial spaces 40, in accordance with some embodiments of the invention. The primary conductors 60 and 80 may be twisted or wound about the longitudinal axis of the wireline cable 24, in accordance with some embodiments of the invention. Alternatively, the primary conductors 60 and 80 are twisted together about at least one secondary conductor 70.

The primary telemetric conductor 80, primary power conductors 60 and secondary power conductors 70 each preferably includes metallic conductors that are encased in an insulated jacket. Any suitable metallic conductors may be used. Examples of metallic conductors include, but are not necessarily limited to, copper, nickel coated copper, or aluminum. While any suitable number of metallic conductors may be used in forming one of these insulated conductors, preferably from 1 to about 60 metallic conductors are used in a particular insulated conductor, and more preferably 7, 19, or 37 metallic conductors may be used.

The insulated jackets may include any of a wide variety of suitable materials. Examples of suitable insulated jacket materials include, but are not necessarily limited to, polytetrafluoroethylene-perfluoromethylvinylether polymer (MFA), perfluoro-alkoxyalkane polymer (PFA), polytetrafluoroethylene polymer (PTFE), ethylene-tetrafluoroethylene polymer (ETFE), ethylene-propylene copolymer (EPC), poly(4-methyl-1-pentene) (TPX® available from Mitsui Chemicals, Inc.), other polyolefins, other fluoropolymers, polyaryletherether ketone polymer (PEEK), polyphenylene sulfide polymer (PPS), modified polyphenylene sulfide polymer, polyether ketone polymer (PEK), maleic anhydride modified polymers, Parmax® SRP polymers (self-reinforcing polymers manufactured by Mississippi Polymer Technologies, Inc based on a substituted poly (1,4-phenylene) structure where each phenylene ring has a substituent R group derived from a wide variety of organic groups), or the like, and any mixtures thereof.

Figure 3:
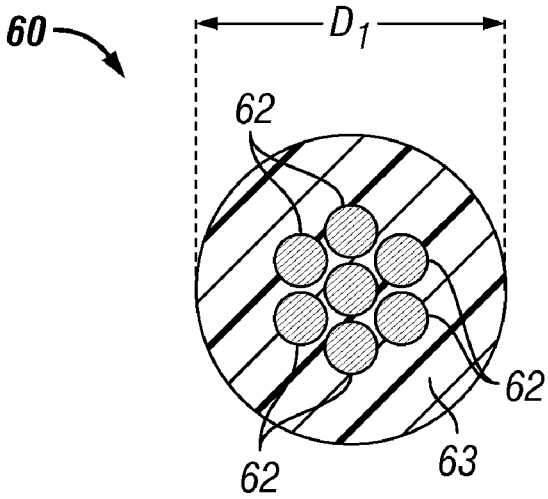
FIG. 3 is a cross-sectional view of a primary power conductor of the wireline cable according to an embodiment of the invention.

As depicted in FIG. 3, the primary power conductor 60 has a diameter $D_1$ and includes inner metallic conductors 62 at the core of the conductor 60, which extend along the primary power conductor's 60 longitudinal axis. The inner metallic conductors 62 are surrounded by an insulated jacket 63.

Figure 4:
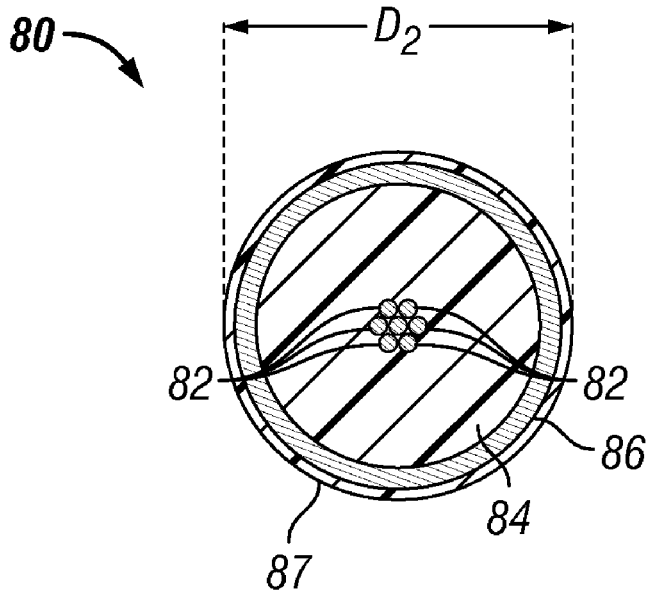
FIG. 4 is a cross-sectional view of a primary telemetric conductor of the wireline cable according to an embodiment of the invention.
Figure 5:
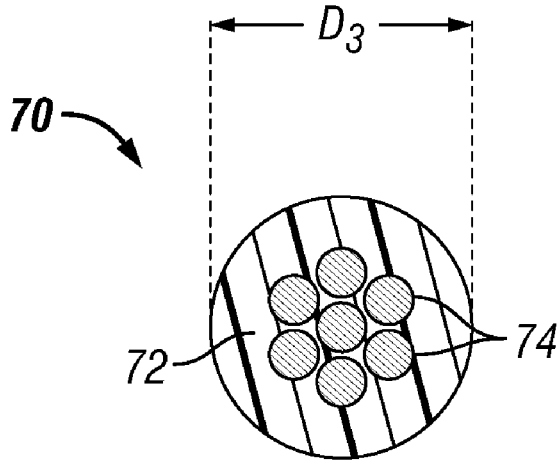
FIG. 5 is a cross-sectional view of a secondary conductor of the wireline cable according to an embodiment of the invention.

Referring to FIG. 4, the primary telemetric conductor 80 is, in accordance with some embodiments of the invention, a coaxial conductor that includes an inner core of metallic conductors 82 that extend along the telemetric conductor's 80 longitudinal axis. Although the inner metallic core of the telemetric primary conductor 80 is smaller than the corresponding inner metallic core of the primary power conductor 60, the primary telemetric conductor 80 includes a relatively larger insulative jacket 84 such that the diameter (called "$D_2$" in FIG. 4) of the primary telemetric conductor 80 is approximately the same size as the $D_1$ diameter (see FIG. 3) of the primary power conductor 60.

As also depicted in FIG. 4, the primary telemetric conductor 80 includes an outer metallic shield 86 (a copper or copper alloy, as examples) for purposes of shielding the inner metallic conductors 82 of the conductor 80 from interference that might otherwise originate, for example, from the power transmissions that occur via the primary power 60 and secondary 70 conductors.

The metallic shield 86 may be any suitable metal or material, which serves to substantially decouple the telemetry that is provided by the inner conductors 82 of the conductor 80 from power transmission. Alternatively, the outer metallic shield 86 is surrounded by a tape or polymeric layer 87 that is disposed on top of the layer 86, in accordance with some embodiments of the invention.

The inner metallic conductors of the primary 60, 80 and secondary 70 conductors may be of any suitable size, also known as American Wire Gauge (AWG). In some embodiments, the metallic conductors range in gauge from 8 AWG to 32 AWG, including all gauges sizes therebetween (i.e. 9, 10, 11, 12, 13, 14, 15, 16, 17, 18, 19, 20, 21, 22, 23, 24, 25, 26, 27, 28, 29, 30, and 31 AWG). In some embodiments of the invention, metallic conductors that are used in the telemetric primary conductor 80 may be in a range from 28 AWG to 18 AWG in size. In some embodiments of the invention, the metallic conductors in the primary power conductors 60 are in a range from 14 AWG to 10 AWG. In some embodiments of the invention, the secondary conductor 70 includes metallic conductors of wire gauge ranging from 16 AWG to 24 AWG.

Referring back to FIG. 2, in accordance with embodiments of the invention, the wireline cable 24 includes a multiple layer armor wire housing, or shield 50, which surrounds the primary 60, 80 and secondary 70 conductors of the cable 24. In this regard, in accordance with some embodiments of the invention, the armor shield 50 includes an inner armor wire wrapping 50*b* that helically extends in a first direction (a counter clockwise direction, for example) about the cable's longitudinal axis and a second outer helical wrapping 50*a* that helically extends in the opposite wrapping direction (a clockwise direction, for example) about the cable's longitudinal axis. Thus, the wrappings 50*a* and 50*b* are contra-helically wound armor wire layers, in accordance with some embodiments of the invention. The wires used to form the armor shield 50 may be steel wires, metals, bimetallics wires, wire rope strands and non-metal wires, as just a few examples. Thus, many variations are contemplated and are within the scope of the appended claims.

The primary 60, 80 and secondary 70 conductors define various interstitial spaces (in addition to the interstitial spaces 40 which at least partially receive the secondary conductors 70), and the cable 24 includes an insulative material 100, such as a polymeric material, that is disposed in these spaces. Furthermore, although not depicted in FIG. 2, the wireline cable 24 may include additional insulative material, such as polymeric material, that is disposed in the interstitial spaces formed between the armor wire wrappings 50*a* and 50*b*. Also, the polymeric material may form a polymeric jacket around an outer or second layer of armor wires. The polymeric material may be chosen and processed in such a way as to prevent a continuously bonded layer of material and which may encase the armor shield 50.

As examples, suitable polymeric materials include EPDM, polyolefins (such as EPC or polypropylene), other polyolefins, polyaryletherether ketone (PEEK), polyaryl ether ketone (PEK), polyphenylene sulfide (PPS), modified polyphenylene sulfide, polymers of ethylene-tetrafluoroethylene (ETFE), polymers of poly(1,4-phenylene), polytetrafluoroethylene (PTFE), perfluoroalkoxy (PFA) polymers, fluorinated ethylene propylene (FEP) polymers, polytetrafluoroethylene-perfluoromethylvinylether (MFA) polymers, Parmax®, and any mixtures thereof. Other polymeric materials that may be used include ethylene-tetrafluoroethylene polymers, perfluoroalkoxy polymers, fluorinated ethylene propylene polymers, polytetrafluoroethylene-perfluoromethylvinylether polymers, and any mixtures thereof.

The wireline cable 24 may also include a bedding layer 94, such as a layer formed from a binder tape and a polymeric material, which surrounds the primary 60, 80 and secondary 70 conductors.

In accordance with some embodiments of the invention, the wireline cable 24 may have an overall diameter, which includes the armor shield 50, of less than about 2.5 centimeters, such as approximately 1.4 centimeters, as a more specific and non-limiting example. Furthermore, in accordance with some embodiments of the invention, the wireline cable 24 may have a minimum bending radius of about 10.1 centimeters. The wireline cable 24 may have other suitable overall diameters, bending stiffnesses and other physical characteristics, in accordance with other embodiments of the invention, as will be appreciated by those skilled in the art.

Among the particular advantages of the wireline cable 24, the cable 24 combines high mechanical stability, high power capability and shielded co-axial telemetry. Mechanical stability is provided by the basic design, as the three large components, i.e., the primary conductors 60 and 80, are less likely to shift under pressure and thus, less likely to allow smaller conductors, such as the secondary conductors 70 and other communication lines (further described below) of the cable 24 to become damaged. Because the larger primary power conductors 60 are used for the larger power requirements, the conductors 60 have lower impedances, which translates to lower cable losses and deeper reach, as compared to power conductors in conventional wireline cables. It is noted that lower power transmission may be handled by the relatively lower secondary power conductors 70. As noted above, all three conductors 70 may be configured to provide three phase power, in accordance with some embodiments of the invention.

Figure 6:
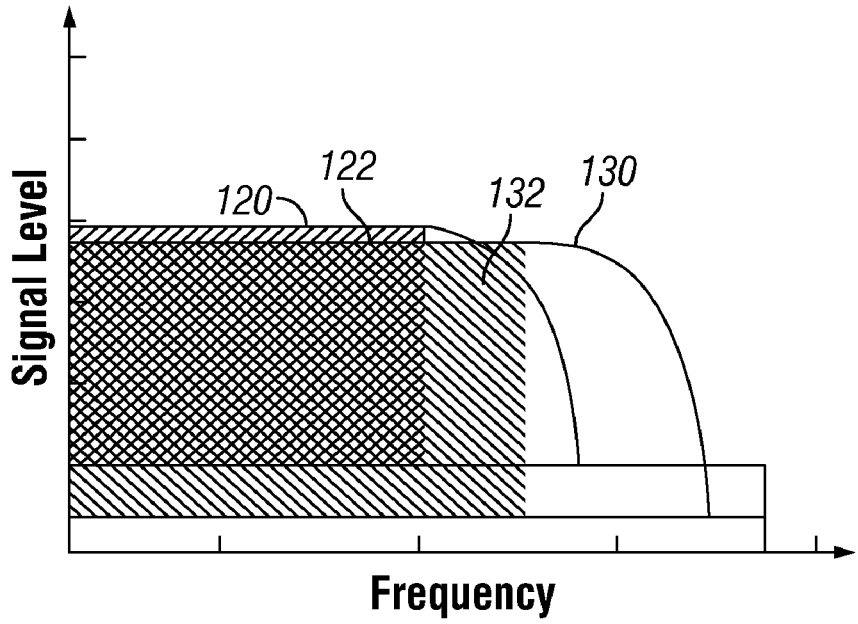
FIG. 6 depicts signal level versus frequency plots for the wireline cable of FIG. 1 and for a conventional wireline cable.

FIG. 6 depicts a signal level versus frequency plot 130 of the telemetry channel provided by wireline cable 24, in accordance with some embodiments of the invention. As shown by the plot 130, the frequency response rolls off at a significantly higher frequency than a frequency plot 120 which characterizes the telemetry channel of a heptacable, for example. As a result, the wireline cable 24 has a significantly higher data capacity 132 than a data capacity 122 of the heptacable, for example.

Figure 7:
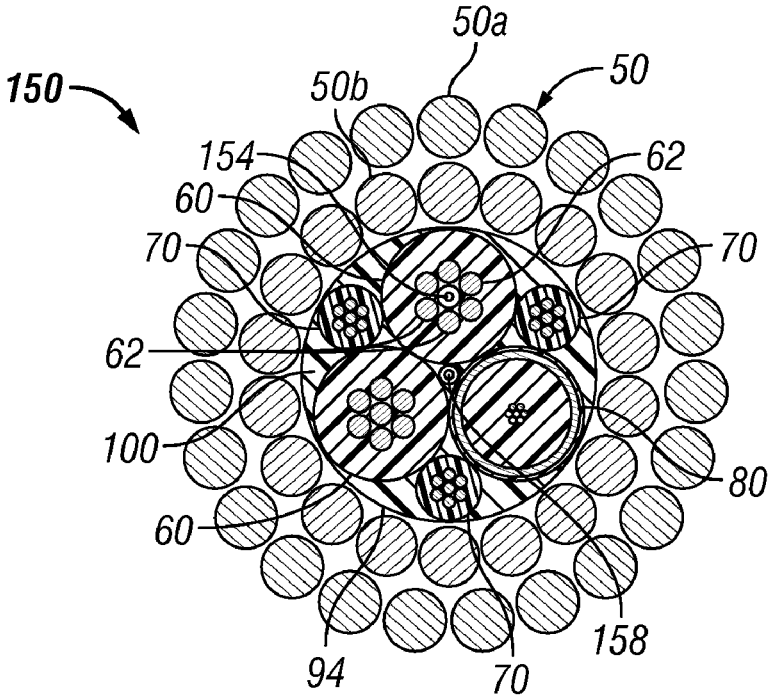
FIGS. 7, 9, 10, 11 12, and 13 are cross-sectional views of wireline cables according to other embodiments of the invention.

FIG. 7 depicts a cross-sectional view of a wireline cable 150 in accordance with an embodiment of the invention. The wireline cable 150 has a similar design to the wireline cable 24, with like reference numerals being used to identify similar components. However, unlike the wireline cable 24, the wireline cable 150 includes a filler rod (a fluoropolymer rod, for example) or an optical fiber 154 disposed in one of the primary power conductors 60; and the wireline cable 150 also includes a filler rod or optical fiber 158 disposed along the longitudinal axis of the wireline cable 150 in the center interstitial space that is created between the three primary conductors 60 and 80. Thus, in accordance with embodiments of the invention, an optical fiber or filler rod component may be placed at the center of the cable 150 or may be incorporated into one of the primary 60, 80 or secondary 70 conductors.

Figure 8:
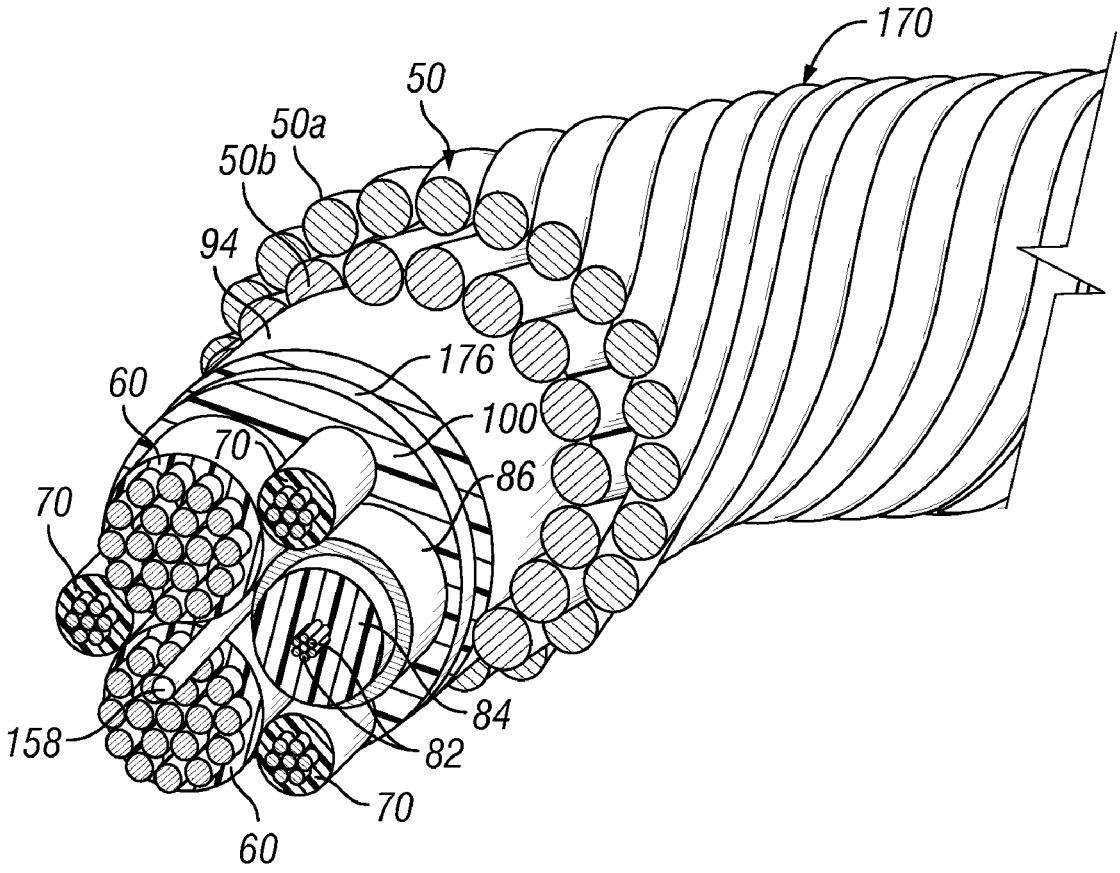
FIG. 8 is a perspective view of a wireline cable depicting a partial cut-away section according to another embodiment of the invention.

FIG. 8 depicts a perspective view of a wireline cable 170 in accordance with an embodiment of the invention. The wireline cable 170 has a similar design to the wireline cable 150 (see FIG. 7) with like reference numerals being used to identify similar components. Unlike the wireline cable 150, the wireline cable 170 includes a single filler rod/optical fiber 158 that extends along the longitudinal axis of the cable 170 and does not include an optical fiber or filler rod in any of the conductors. As depicted in FIG. 8, the wireline cable 170 may have tape 176 disposed over the conductors and polymeric material 100, as well as the outer metallic shield 86 for the primary telemetric conductor 80. The wireline cable 170 may also include a bedding layer or jacket 94, such as a layer formed from a binder tape and a polymeric material, which surrounds the primary 60, 80 and secondary 70 conductors.

Figure 9:
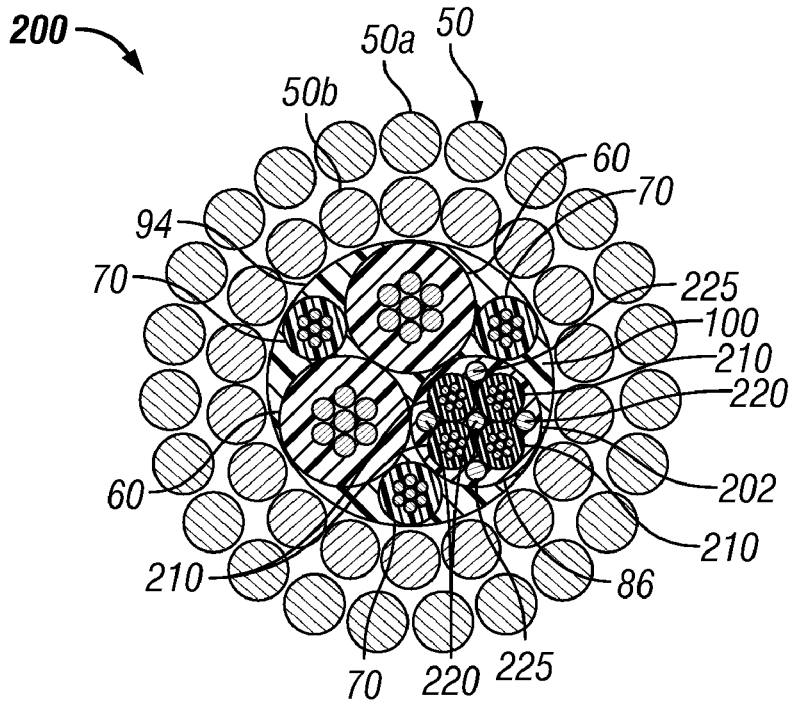

FIG. 9 depicts a cross-sectional view of a wireline cable 200 in accordance with an embodiment of the invention. In general, the wireline cable 200 has a similar design to the wireline cable 24 of FIG. 2, with like reference numerals being used to identify similar components. However, the wireline cable 200 has a primary telemetric conductor 202 that replaces the primary telemetric conductor 80 of the wireline cable 24. The primary telemetric cable 202, in general, has approximately the same diameter as the two primary power conductors 60, but unlike the conductor 80 of the wireline cable 24, the conductor 202 employs quad or quadrature telemetry. In this regard, the conductor 202 has four telemetry conductors 210 that are located and shielded by the surrounding metallic shield 86, an arrangement that permits two orthogonal telemetry transmission paths.

The primary telemetric conductor 202 may also include filler rods 225 and drain wires 220, which may be alternated with the filler rods at the outside interstitial spaces formed between the conductors 210.

The shielded design is advantageous for applications requiring high signal-to-noise ratios and lower frequencies. Alternatively, the shield may be omitted if lower signal-to-noise ratios and higher frequencies are desired.

Figure 10:
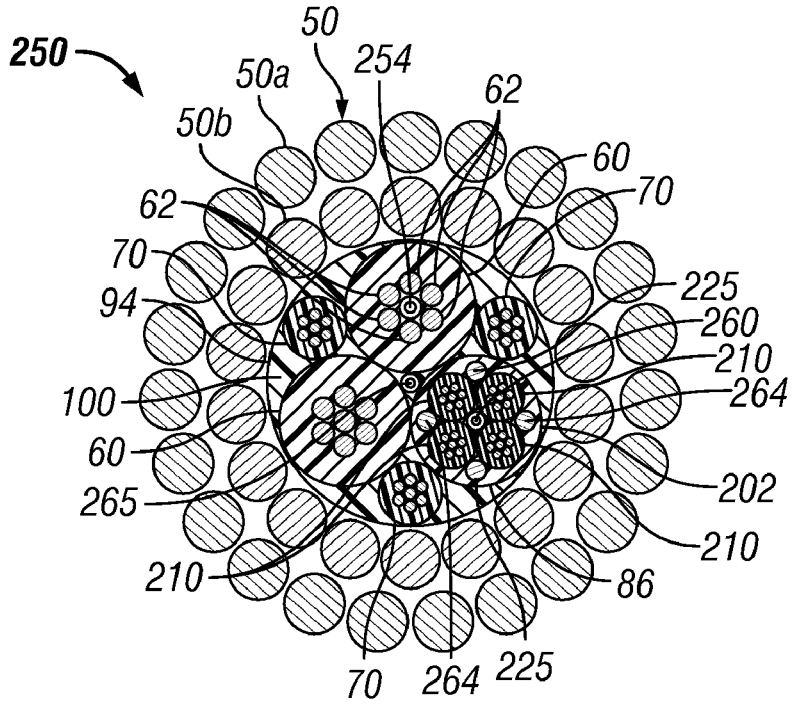

FIG. 10 depicts a cross-sectional view of a wireline cable 250 in accordance with an embodiment of the invention. In general, the wireline cable 250 has a similar design to the wireline cable 200, with like reference numerals being used to identify similar components. However, unlike the wireline cable 200, the wireline cable 250 includes an optical cable 254 that extends along the center of one of the primary power conductors 60. Also, an optical fiber 265 may extend along the longitudinal axis of the cable 250. Furthermore, the center filler rods 220 of the wireline cable 200 in the primary telemetric conductor 202 is replaced in FIG. 10 with an optical fiber 260.

Figure 11:
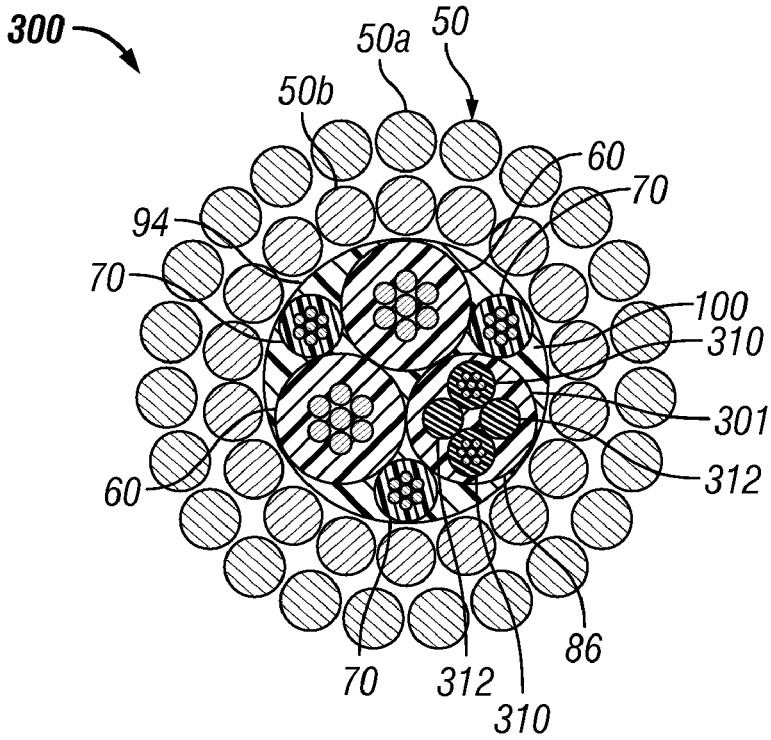

FIG. 11 depicts a cross-sectional view of a wireline cable 300, which has a similar design to the wireline cable 24 of FIG. 2 with like reference numerals being used to identify similar components. However, the primary telemetric conductor 80 of the wireline cable 24 is replaced in the wireline cable 300 with a primary telemetric conductor 301. The primary telemetric conductor 301 includes two telemetry conductors 310, which may have approximately the same diameter as each of the secondary power conductors 70. The telemetry conductors 310 are arranged in a twisted-pair configuration. The primary telemetry conductor 301 may also include drain wires or filler rods 312 that are placed on the outside of the conductors 310 in interstitial spaces formed between the conductors 310.

Figure 12:
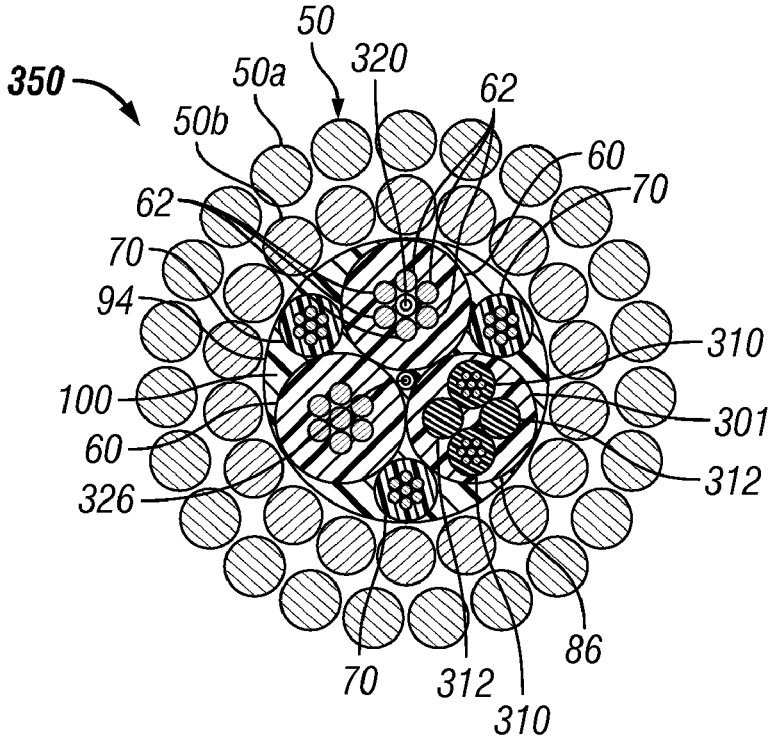

The wireline cable 300 may further be enhanced by adding optical components at various locations throughout the cable core. In this regard, in an embodiment of the invention, a wireline cable 350 (see FIG. 12) has a similar design to the wireline cable 300, with like reference numerals being used to identify similar components. Unlike the wireline cable 300, the wireline cable 350 includes optical fibers 320 and 326, which may be disposed at the center of one of the primary power conductors 60 and the center of the cable 300, respectively.

In some embodiments of the invention, the insulated power conductors, primary and/or secondary, are stacked dielectric insulated conductors, with electric field suppressing characteristics, such as those used in the cables described in U.S. Pat. No. 6,600,108 (Mydur, et al.), which is hereby incorporated by reference in its entirety. Such stacked dielectric insulated conductors generally include a first insulating jacket layer disposed around the metallic conductors wherein the first insulating jacket layer has a first relative permittivity, and, a second insulating jacket layer disposed around the first insulating jacket layer and having a second relative permittivity that is less than the first relative permittivity. The first relative permittivity is preferably within a range of about 2.5 to about 10.0, and the second relative permittivity is preferably within a range of about 1.8 to about 5.0.

As discussed above, cables, such as the cables 24, 150, 170, 200 and 250, according to embodiments of the invention include at least one layer of armor wires, such as the armor wire wrappings 50*a* or 50*b*, surrounding the primary 60, 80 and secondary 70 conductors. The armor wires may be generally made of any high tensile strength material including, but not necessarily limited to, galvanized improved plow steel, a layered mixture of metals such in bimetallic form, alloy steel, or the like. In some embodiments of the invention, the cable includes an inner armor wire layer surrounding the conductors and an outer armor wire layer served around the inner armor wire layer. A protective polymeric coating may be applied to each strand of armor wire for corrosion protection or even to promote bonding between the armor wire and polymeric material disposed in the interstitial spaces.

As used herein, the term "bonding" is meant to include chemical bonding, mechanical bonding, or any combination thereof. Examples of coating materials which may be used include, but are not necessarily limited to, fluoropolymers, fluorinated ethylene propylene (FEP) polymers, ethylene-tetrafluoroethylene polymers (Tefzel®), perfluoro-alkoxyalkane polymer (PFA), polytetrafluoroethylene polymer (PTFE), polytetrafluoroethylene-perfluoromethylvinylether polymer (MFA), polyaryletherether ketone polymer (PEEK), or polyether ketone polymer (PEK) with fluoropolymer combination, polyphenylene sulfide polymer (PPS), PPS and PTFE combination, latex or rubber coatings, and the like.

Each armor wire, such as the armor wire wrappings 50*a* or 50*b*, may also be plated with materials for corrosion protection or even to promote bonding between the armor wire and polymeric material. Nonlimiting examples of suitable plating materials include brass, copper alloys, and the like. Plated armor wires may even comprise cords such as tire cords. While any effective thickness of plating or coating material may be used, a thickness from about 10 microns to about 100 microns may be used, as an example.

Figure 13:
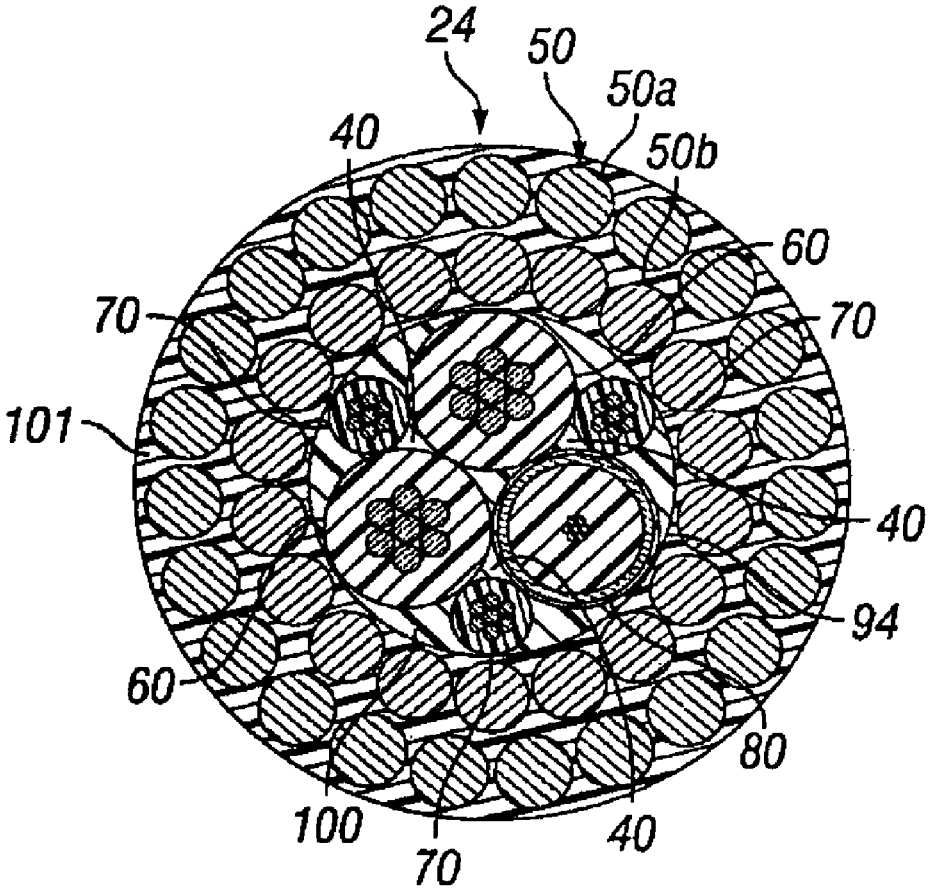

In some cables, such as the cables 24, 150, 170, 200 and 250, polymeric material 101, best seen in FIG. 13, such as the polymeric material 100 or the like, may be disposed in the interstitial spaces formed between armor wires, and interstitial spaces formed between the armor wire layer and insulated conductor. It is believed that disposing a polymeric material such as the polymeric material 101 throughout the armor wires interstitial spaces, or unfilled annular gaps, among other advantages, prevents dangerous well gases from migrating into and traveling through these spaces or gaps upward toward regions of lower pressure, where it becomes a fire, or even explosion hazard.

In cables, such as the cables 24, 150, 170, 200 and 250, according to embodiments of the invention, the armor wires are preferably partially or completely sealed by a polymeric material, such as the polymeric material 100, 101, or the like, that completely fills all interstitial spaces, therefore eliminating any conduits for gas migration. Further, incorporating a polymeric material in the interstitial spaces provides torque balanced two armor wire layer cables, since the outer armor wires are locked in place and protected by a tough polymer jacket, and larger diameters are not required in the outer layer, thus mitigating torque balance problems. Additionally, since the interstitial spaces are filled, corrosive downhole fluids cannot infiltrate and accumulate between the armor wires. The polymeric material may also serve as a filter for many corrosive fluids. By minimizing exposure of the armor wires and preventing accumulation of corrosive fluids, the useful life of the cable may be significantly increased.

When incorporated, filling the interstitial spaces between armor wires and separating the inner and outer armor wires with a polymeric material reduces point-to-point contact between the armor wires, thus improving strength, extending fatigue life, and while avoiding premature armor wire corrosion. Because the interstitial spaces are filled, the cable core is completely contained and creep is mitigated, and as a result, cable diameters are much more stable and cable stretch is significantly reduced. The creep-resistant polymeric materials used in embodiments of the invention may minimize core creep in two ways: first, locking the polymeric material and armor wire layers together greatly reduces cable deformation; and secondly, the polymeric material also may eliminate any annular space into which the cable core might otherwise creep.

Cables, such as the cables 24, 150, 170, 200 and 250, according to embodiments of the invention may improve problems encountered with caged armor designs, since the polymeric material encapsulating the armor wires may be continuously bonded it cannot be easily stripped away from the armor wires. Because the processes described herein allow standard armor wire coverage (93-98% metal) to be maintained, cable strength may not be sacrificed in applying the polymeric material, as compared with typical caged armor designs.

The polymeric material, such as the polymeric material 100, 101, or the like,used in some embodiments of the invention may be disposed continuously and contiguously from the insulated conductors to the layer of armor wires, or may even extend beyond the outer periphery thus forming a polymeric jacket that completely encases the armor wires. The polymeric material forming the jacket and armor wire coating material may be optionally selected so that the armor wires are not bonded to and can move within the polymeric jacket.

In some embodiments of the invention, the polymeric material, such as the polymeric material 100 or the like, may not have sufficient mechanical properties to withstand high pull or compressive forces as the cable is pulled, for example, over sheaves, and as such, may further include short fibers. While any suitable fibers may be used to provide properties sufficient to withstand such forces, examples include, but are not necessarily limited to, carbon fibers, fiberglass, ceramic fibers, Kevlar® fibers, Vectran® fibers, quartz, nanocarbon, or any other suitable material. Further, as the friction for polymeric materials including short fibers may be significantly higher than that of the polymeric material alone, an outer jacket of polymeric material without short fibers may be placed around the outer periphery of the cable so the outer surface of cable has low friction properties.

The polymeric material, such as the polymeric material 100 or the like, used to form the polymeric jacket or the outer jacket of cables according to embodiments of the invention may also include particles which improve cable wear resistance as it is deployed in wellbores. Examples of suitable particles include Ceramer™, boron nitride, PTFE, graphite, nanoparticles (such as nanoclays, nanosilicas, nanocarbons, nanocarbon fibers, or other suitable nano-materials), or any combination of the above.

Wireline cables, such as the cables 24, 150, 170, 200 and 250, according to embodiments of the invention may also have one or more of the armor wires replaced with coated armor wires. The coating may include the same material as those polymeric materials described hereinabove. This may help improve torque balance by reducing the strength, weight, or even size of the outer armor wire layer, while also improving the bonding of the polymeric material to the outer armor wire layer.

The materials forming the insulating layers and the polymeric materials used in the cables according to embodiments of the invention may further include a fluoropolymer additive, or fluoropolymer additives, in the material admixture to form the cable. Such additive(s) may be useful to produce long cable lengths of high quality at high manufacturing speeds. Suitable fluoropolymer additives include, but are not necessarily limited to, polytetrafluoroethylene, perfluoroalkoxy polymer, ethylene tetrafluoroethylene copolymer, fluorinated ethylene propylene, perfluorinated poly(ethylene-propylene), and any mixture thereof.

The fluoropolymers may also be copolymers of tetrafluoroethylene and ethylene and optionally a third comonomer, copolymers of tetrafluoroethylene and vinylidene fluoride and optionally a third comonomer, copolymers of chlorotrifluoroethylene and ethylene and optionally a third comonomer, copolymers of hexafluoropropylene and ethylene and optionally third comonomer, and copolymers of hexafluoropropylene and vinylidene fluoride and optionally a third comonomer.

The fluoropolymer additive should have a melting peak temperature below the extrusion processing temperature, and preferably in the range from about 200° C. to about 350° C. To prepare the admixture, the fluoropolymer additive is mixed with the insulating jacket or polymeric material. The fluoropolymer additive may be incorporated into the admixture in the amount of about 5% or less by weight based upon total weight of admixture, preferably about 1% by weight based or less based upon total weight of admixture, more preferably about 0.75% or less based upon total weight of admixture.

Components used in cables according to embodiments of the invention may be positioned at zero lay angle or any suitable lay angle relative to the center or longitudinal axis of the cable. Generally, the central component is positioned at zero lay angle, while strength members surrounding the central component(s) are helically positioned around the central component(s) at desired lay angles.

In accordance with some embodiments of the invention, the cable may include at least one filler rod component, such as the filler rods 158, 220, 225, and 312, or the like, in the armor wire layer. In such cables, one or more armor wires are replaced with a filler rod component, which may include bundles of synthetic long fibers or long fiber yarns. The synthetic long fibers or long fiber yarns may be coated with any suitable polymers, including those polymeric materials described hereinabove. The polymers may be extruded over such fibers or yarns to promote bonding with the polymeric jacket materials. This may further provide stripping resistance. Also, as the filler rod components replace outer armor wires, torque balance between the inner and outer armor wire layers may further be enhanced.

The cable, such as the cables 24, 150, 170, 200 and 250, in accordance with embodiments of the invention, may include armor wires employed as electrical current return wires, which provide paths to ground for downhole equipment or tools. The armor wires may be used for current return while minimizing electric shock hazard. In some embodiments of the invention, the polymeric material isolates at least one armor wire in the first layer of armor wires thus enabling their use as electric current return wires.

The cables, such as the cables 24, 150, 170, 200 and 250, that are disclosed herein may be used with wellbore devices to perform operations in wellbores penetrating geologic formations that may contain gas and oil reservoirs. The cables may be used to interconnect well logging tools, such as gamma-ray emitters/receivers, caliper devices, resistivity-measuring devices, seismic devices, neutron emitters/receivers, and the like, to one or more power supplies and data logging equipment outside the well, among any other suitable application.

The cables, such as the cables 24, 150, 170, 200 and 250, disclosed herein may also be used in non-wireline applications, such as in seismic operations, which include subsea and subterranean seismic operations. As another example, the cables disclosed herein may be used as permanent monitoring cables for wellbores and for well completions. Thus, many variations and applications of the cables disclosed herein are contemplated and are within the scope of the appended claims.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

We claim:

1. An electrical cable defining a longitudinal axis and usable with a well, comprising:

a plurality of insulated primary power conductors extending along the cable and a shielded telemetric primary conductor extending along the cable and defining interstices between adjacent primary conductors, the insulated primary conductors and the telemetric primary conductor having approximately the same diameter, the telemetric primary conductor including a plurality of telemetry conductors;

a plurality of insulated secondary conductors each having a diameter smaller than the diameter of each of the primary conductors and extending along the longitudinal axis of the cable, each of said secondary conductors at least partially nested in one of the interstices;

a layer of inner armor wires surrounding said insulated primary conductors, said telemetric primary conductor, and said at least one insulated secondary conductor;

a layer of outer armor wires surrounding the layer of inner armor wires, said primary conductors, said secondary conductor, and said armor wires defining interstices therebetween;

a polymeric material disposed in the interstices formed between the inner armor wires and the outer armor wires and in interstitial spaces formed between the inner armor wire layer and insulated conductor, the polymeric material forming a continuously bonded layer which separates and encapsulates said inner armor wire layer and said outer armor wire layer; and an outer jacket disposed around and bonded with said polymeric material.

2. The cable of claim 1, wherein said primary power conductors and said telemetric primary conductor are arranged in a triangular pattern about a longitudinal axis of the cable.

3. The cable of claim 1, wherein the cable comprises a wireline cable, a cable installed in a well completion, or a seismic data acquisition cable.

4. The cable of claim 1, wherein said at least one telemetric primary conductor comprises a coaxial conductor.

5. The cable of claim 1, wherein said plurality of insulated secondary conductor comprises three secondary conductors.

6. The cable of claim 1, wherein an overall diameter of the cable is less than approximately 2.5 centimeters.

7. The cable of claim 1, wherein the cable has a minimum bending radius of about 10.1 centimeters.

8. The cable of claim 1, further comprising at least one filler rod extending along the cable.

9. The cable of claim 8, wherein said at least one filler rod is at least partially nested in the interstices formed by the primary conductors.

10. The cable of claim 1, further comprising at least one filler rod extending inside at least one of the primary power conductors and the telemetric primary conductor.

11. The cable of claim 1, further comprising a binder tape surrounding the primary and secondary conductors.

12. The cable of claim 1, wherein said at least one telemetric primary conductor comprises an insulating jacket, a plurality of metallic conductors encased in the insulating jacket, and a metallic layer disposed upon a peripheral surface of the insulating jacket.

13. The cable of claim 1, wherein said secondary conductors comprise three insulated secondary conductors configured to provide three-phase power.

14. The cable of claim 1, further comprising at least one drain wire disposed in the shielded telemetric primary conductor.

15. The cable of claim 1, further comprising at least one filler rod disposed in the telemetric primary conductor.

16. The cable of claim 1, further comprising an optical fiber positioned in one of said primary power conductors and said primary telemetric conductor.

17. The cable of claim 1, wherein the telemetric primary conductor comprises a shielded conductor to improve a signal-to-noise ratio associated with the telemetric primary conductor.

18. The cable of claim 1, wherein the shielded telemetric primary conductor is substantially decoupled from power transmission of the cable.

19. The cable of claim 1, wherein an overall diameter of the cable is approximately 1.4 centimeters.

* * * * *